United States Patent [19]

Kupisiewicz

[11] 4,054,284

[45] Oct. 18, 1977

[54] PAPER ANTI-SKEW DEVICE

[75] Inventor: Janusz W. Kupisiewicz, Arcadia, Calif.

[73] Assignee: Xerox Corporation, Stamford, Conn.

[21] Appl. No.: 555,654

[22] Filed: Mar. 5, 1975

[51] Int. Cl.[2] ..... B65H 1/04

[52] U.S. Cl. ..... 271/8 R; 271/167

[58] Field of Search ..... 271/8 R, 145–148, 271/152–160, 162–164, 167–171

[56] References Cited

FOREIGN PATENT DOCUMENTS 1,189,931 10/1959 France ..... 271/160

OTHER PUBLICATIONS

*IBM Technical Disclosure Bulletin*, vol. 18, No. 1, "Sheet Separator", J. D. Froula, June 1975.

*Primary Examiner*—Robert W. Saifer

[57] ABSTRACT

A paper anti-skew device for maintaining alignment and preventing skewing of sheets fed from a stack into a copy sheet mass in an electrostatic copying machine for producing copies of documents. Sheets are fed from lead edge by a top feeding pneumatic device in seriatim. The anti-skew device rests on top of the stack of sheets along the trailing edge of the stack and is longitudinally coextensive with the trailing edge thereof. Corner portions extend from the longitudinal portion of the member at an angle of 90° for a predetermined distance to maintain alignment of the trailing corners of the topmost sheets as they are fed and which may stick and skew relative to the direction of the copy sheet path in the absence of the anti-skew device.

8 Claims, 5 Drawing Figures

PAPER ANTI-SKEW DEVICE

This invention relates in general to sheet handling apparatus and in particular to a sheet anti-skew device for maintaining registration of the corners of the topmost sheets in the stack as they are fed in a duplicating machine or the like for producing copies.

In the reproduction field in which electrostatic machines are used for reproducing copies, mis-feeding of sheet materials fed from a stack is a complex problem which can cause machine down time. The complex nature of this type of equipment frequently requires that a skilled attendant manually adjusts a stack of sheets to prevent mis-feeding under certain conditions such as changes in environmental conditions and the like. Under certain humidty conditions it has been experienced that sheet being fed from the top of a stack of sheets may stick as the topmost sheet is fed by a suction device or the like causing skewing of the next sheet or sheets and thus a mis-fed or jam condition to occur, The present invention is a simple and reliable inexpensive anti-skew device which is adapted to prevent the mis-registration of the topmost sheets in a stack which are being fed along a copy sheet path of a duplicating machine or the like. The anti-skew device of the invention generally speaking, is a lightweight device which rests on top of a stack of sheets along the trailing edge thereof and maintains corner registration of the topmost sheets as they are being fed by a top feeding device along the lead edge thereof.

It is therefore a general object of this invention to improve sheet handling for electrostatographic machines.

It is another object of the present invention to enable feeding of a stack of sheets from the top while preventing skewing of the topmost sheet in the stack as they are being fed.

It is another object of the present invention to provide a paper stack device for aligning the corners of the topmost sheets of a stack as they are fed in succession from the top of a stack.

It is still another object of the present invention to improve the feeding of a stack of sheets in a duplicating machine by enabling the topmost sheets to be fed while imparting constraining forces to the corners of the topmost sheets in the stack.

Further objects of the invention together with additional features and advantages will be apparent from the following description when read in conjunction with the accompanying drawings wherein.

Figure 1:
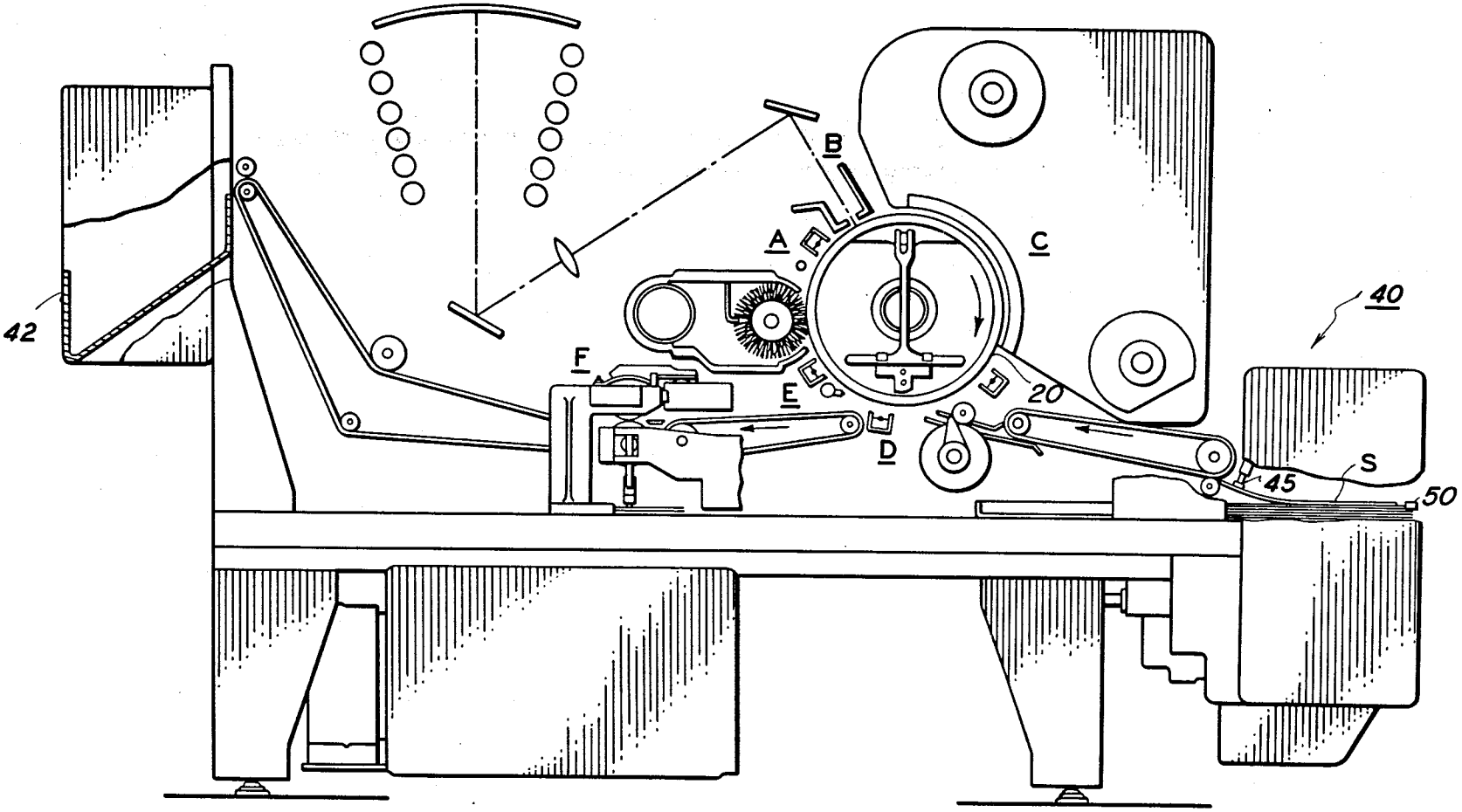
FIG. 1 illustrates schematically a preferred embodiment of an electrostatographic duplicating machine in which copy sheets are fed from the stack having an improved anti-skewing device constructed in accordance with the present invention.

As shown schematically in FIG. 1, the electrostatographic machine is automatic and includes a xerographic plate 20 including a photoconductive layer or light receiving surface which is on a conductive backing and is journaled in a frame to rotate in the direction indicated by the arrow to pass a plurality of processing stations.

For purposes of the present disclosure the several processing stations in the path of movement of the xerographic plate surface may be described functionally as follows:

A changing station A at which a uniform electrostatic charge is deposited on the photoconductive surface.

An exposure station B at which a light or radiation pattern of a document to be reproduced is projected onto the plate surface and dissipates the charge in the exposed areas thereof and thereby forms a latent electrostatic image of the document which is being produced;

A developing station C at which the developer material including toner particles having an electrostatic charge opposite to that of the electrostatic latent image are cascaded over the plate surface whereby the toner particles adhere to the electrostatic latent image to form a toner powder image in the configuration of the document being reproduced;

A transfer station D in which the toner powder image is electrostatically transferred from the plate surface to the copy sheet material which is fed from a stack of sheets S by a sheet feed mechanism generally designated 40;

A drum cleaning and discharge station E at which the plate surface is brushed to remove residual toner particles after image transfer in which the plate surface is discharged from any residual electrostatic charges remaining thereon;

A fusing station F at which the copy sheets bearing the toner image pattern are directed to permanently affix the toner images thereto before being transported to a copy receiving tray 42.

It is believed that the foregoing description is sufficient for purposes of describing the xerographic processing stations to show the general operation thereof for purposes of the anti-skew devices of the present invention. For further details concerning the specific construction of the components previously described, reference is made to a U.S. Pat. No. 3,301,126 issued in the name of R. F. Osborne et al and commonly assigned herewith.

In accordance with the present invention a stack of copy sheets S is fed by a sheet feed mechanism generally designated 40 by a suction or pneumatic device 45 which feeds the topmost sheet into the machine.

Figure 2:
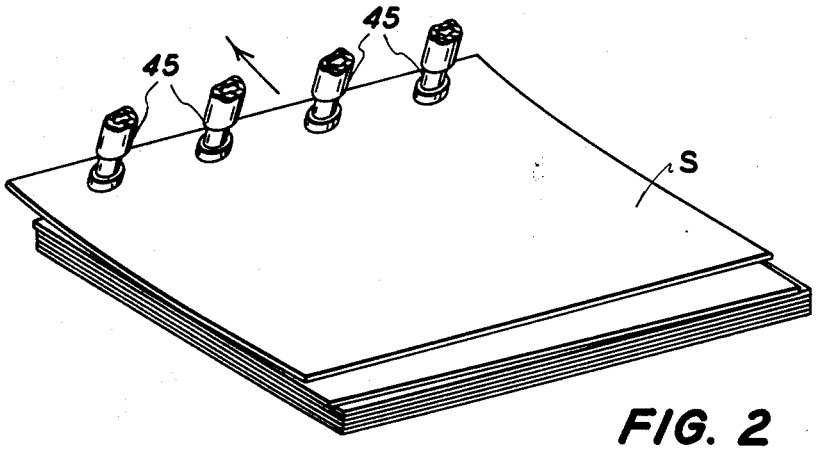
FIG. 2 is a perspective view of the prior art sheet-feeding device in the absence of an anti-skew device according to the present invention.
Figure 3:
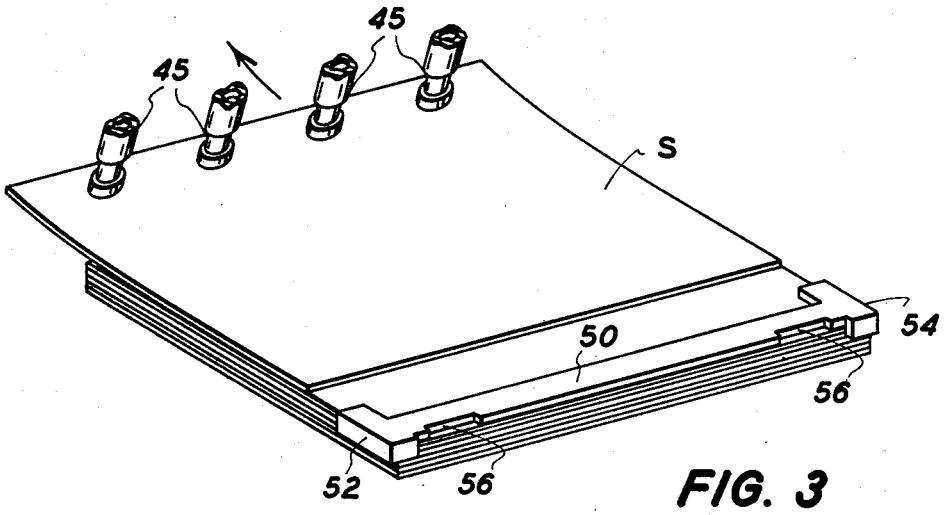
FIG. 3 is a perspective view similar to FIG. 2 in which the stack of sheets to be fed includes an anti-skew device according to the present invention.
Figure 4:
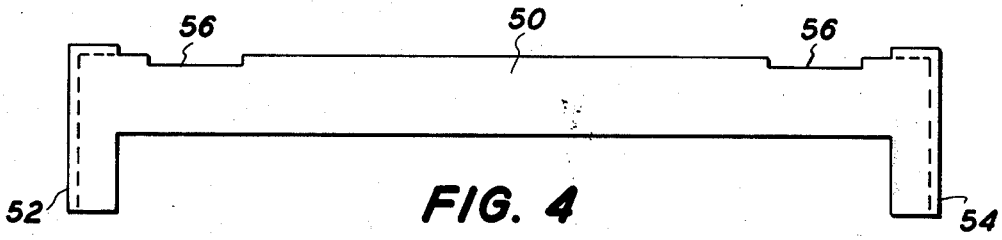
FIG. 4 is a plan view of the anti-skew device of the invention.
Figure 5:
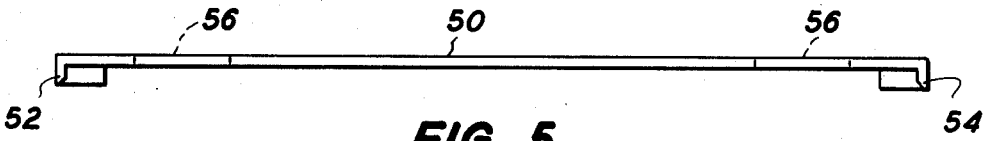
FIG. 5 is an end view of the anti-skew device.

The sheet of the stack S is fed by a suction or pneumatic device 45 one sheet at a time as the stack is moved upwardly by a tray mechanism not shown. It will be appreciated especially under extreme conditions of humidity that sticking or adhesion of the sheets may occur whereby when the topmost sheet is fed sheets are misaligned with the sheet corners resulting in relative movement or skewing of the topmost sheets relative to the center line of the sheet path (FIG. 2). It has been experienced that sheets which are not properly registered are not fed along a sheet path and can cause a jam necessitating machine down time to remove the misfed sheet or sheets.

Referring now particularly to FIGS. 30–35 it is shown that the anti-skew device generally designated 50 which is positioned on top of the stack of sheets S along the trailing edge of the stack. The anti-skew device 50 is co-extensive with the length of the back of sheets along the longitudinal dimension thereof and has corner portions 52 and 54 which extend at an angle of 90° to the longitudinal portion to receive the corners of the stack at the trailing edge thereof. In this manner the corners of the trailing edge of the stack of sheets of the topmost sheets are maintained in proper registration with the stack and are prevented from skewing as the topmost sheet is fed. It will be noted that the longitudinal dimension of the anti-skew device 50 is co-extensive with the length of the stack of sheets such that corner portions 52 and 54 extend directly over the corners of the topmost sheets. Width of the anti-skew device is sufficiently wide to cover the trail edge portion of the topmost sheets. It has been found that length and width ratio ranging from about 8 to 1 to about 15 to 1 works well for this purpose.

The anti-skew device corner portions 52 and 54 extend for a sufficient distance to include at least several of the topmost sheets. The height fo the corner portions 52 and 54 ranges from about one-eighth to about one-half inch and preferably to about one-fourth of an inch. It will be appreciated further that the corner portions 52 and 54 are beveled to facilitate placement of the anti-skew device over the top of the stack of sheets. It will be further appreciated that the longitudinal portion of the anti-skew device has cutouts 56 which are for the purpose of accommodating parts of a tray mechanism (not shown) so that a snug fit may be obtained along the trailing edge of the stack of sheets to be fed. Cutout portions 56 may be omitted without departing from the spirit of the invention The anti-skew device may be made from any suitable lightweight material. Suitable materials are plastic, rubber, metal, and combinations thereof. A preferred method of making the device is by injection molding techniques known by those skilled in the art.

While the invention has been described with reference to the structure disclosed herein it is not to be confined to the specific details set forth. Thus, other modifications or changes may readily become apparent to those skilled in the art and therefore this application is intended to cover such modifications or changes as may come within the purposes of the improvements of the scope of the following claims.

What is claimed is:

1. In an electrostatographic copying machine in which copies of documents are reproduced on copy sheets which are fed from a stack by a top feeding device along a copy sheet path, an improved sheet anti-skew device for maintaining alignment of the edges of the topmost sheets of the stack comprising:

an elongated member positioned to rest on a top of a stack of sheets to be fed, said member longitudinally extending along the trailing edge of said stack, said member having corner portions extending vertically at an angle of 90° from the longitudinal extent of the member for a predetermined distance to receive corners of the topmost sheets to prevent the skewing thereof as they are fed from the top of said stack.

2. A device according to claim 1 wherein the length and width ratio of the member ranges from about 8 to 1 to about 15 to 1.

3. A device according to claim 1 wherein the corner portions of the member extend vertically for a distance of about a quarter of an inch.

4. A device according to claim 1 wherein said member is made from a lightweight material selected from a group consisting of plastic, rubber, metal and combinations thereof.

5. A device according to claim 1 wherein the corner portions of the member extend vertically for a distance ranging from about one-eighth inch to about one-half inch.

6. In an electrostatographic copying machine in which copies of documents are reproduced on copy sheets which are fed from a stack by a top feeding device along a copy sheet path, an improved sheet anti-skew device for maintaining alignment of the edges of the topmost sheets of the stack comprising:

and elongated member positioned to rest on top of a stack of sheets to be fed, said member longitudinally extending along the trailing edge of said stack, said member having corner portions extending vertically at an angle of 90° from the longitudinal extent of the member for a predetermined distance to receive corners of the topmost sheets to prevent skewing thereof as they are fed from the top of a stack, wherein said corner portions are beveled to facilitate placement of the member on the top of the stack of sheets.

7. In a sheet-feeding device in which sheets of rectangular shape are arranged in a stack from which the uppermost sheet is advanced forwardly during a feed cycle by engagement of the top sheet of the stack adjacent the forward edge, a bracket adapted to be positioned on top of the stack across the rearward edge in which the bracket consists essentially of an integral member having a horizontally disposed top wall dimensioned to have a length to rest only on a small segment of the top of the stack across the rearward edge portion, a back wall which depends perpendicularly from the rearward edge of the top wall for a short distance to engage the upper portion of the stack across the back side, and side walls which extend perpendicularly from the top and back walls and are spaced by an amount corresponding to the length of the sheets in the stack to embrace the upper rearward end portions of the side walls of the stack.

8. A method for preventing paper jamming of a machine by paper plates fed from the top of a stack forwardly into the machine in response to engagement of the top sheet in the stack adjacent its forward edge during the paper feeding cycle comprising positioning onto the rearward end portion of the stack on integral free-floating bracket having a top wall portion which rests on only a small segment of the top of the stack across the rearward edge portion, a back wall which depends perpendicularly for a short distance from the rearward edge of the top wall in position to engage the back side of the stack across the upper edge portion, and side walls which are spaced one from the other by an amount corresponding to the length of the paper in the stack to engage the upper rearward corners of the stack whereby, in response to forward displacement of the uppermost sheet in the stack in feeding relation, the bracket is brought into engagement to effect realignment of any misaligned sheets and to prevent misalignment of uppermost sheets in the stack.

* * * * *